US009805671B2

(12) United States Patent
Kim et al.

(10) Patent No.: US 9,805,671 B2
(45) Date of Patent: Oct. 31, 2017

(54) CURVED DISPLAY AND A DRIVING METHOD THEREOF

(71) Applicant: Samsung Display Co., Ltd., Yongin-si, Gyeonggi-do (KR)

(72) Inventors: Tae Hyung Kim, Anyang-si (KR); Kang-Min Kim, Hwaseong-si (KR); Jeong Min Sung, Seoul (KR); Hyung Woo Yim, Goyang-si (KR); Hyeon Yong Jang, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 17 days.

(21) Appl. No.: 14/984,901

(22) Filed: Dec. 30, 2015

(65) Prior Publication Data

US 2016/0196794 A1 Jul. 7, 2016

(30) Foreign Application Priority Data

Jan. 6, 2015 (KR) ..... 10-2015-0001364

(51) Int. Cl.
*G09G 3/36* (2006.01)

(52) U.S. Cl.
CPC ... *G09G 3/3611* (2013.01); *G09G 2340/0414* (2013.01); *G09G 2340/0421* (2013.01); *G09G 2340/0471* (2013.01); *G09G 2340/0478* (2013.01); *G09G 2354/00* (2013.01)

(58) Field of Classification Search
CPC ..... G09G 3/003; G09G 3/20; G09G 3/30; G09G 3/2074; G09G 3/3611; G09G 5/37–5/38; G06T 19/00; G06T 5/00
See application file for complete search history.

(56) References Cited

U.S. PATENT DOCUMENTS

| | | | | |
|---|---|---|---|---|
| 9,117,384 | B2 * | 8/2015 | Phillips | G06F 3/012 |
| 2012/0235893 | A1 | 9/2012 | Phillips et al. | |
| 2014/0055696 | A1 | 2/2014 | Lee et al. | |
| 2014/0292621 | A1 * | 10/2014 | Kim | H04N 5/64 345/76 |
| 2016/0093240 | A1 * | 3/2016 | Aurongzeb | G09G 3/3225 345/590 |

FOREIGN PATENT DOCUMENTS

| | | | |
|---|---|---|---|
| JP | 11-149566 | A | 6/1999 |
| JP | 2002-006797 | A | 1/2002 |
| JP | 2006-30225 | A | 2/2006 |
| KR | 10-2013-0117110 | A | 10/2013 |

* cited by examiner

*Primary Examiner* — Jennifer Mehmood
*Assistant Examiner* — Sardis F Azongha
(74) *Attorney, Agent, or Firm* — Innovation Counsel LLP

(57) ABSTRACT

A curved display device includes a curved panel including a plurality of pixels, and an image compensation processor. The image compensation processor is configured to convert a first image signal into a second image signal by scaling the first image signal based on a curvature of the curved panel and a viewing distance between a viewer and the curved panel, map the second image signal onto corresponding pixels of the curved panel, and provide the mapped second image signal to the corresponding pixels of the curved panel.

15 Claims, 17 Drawing Sheets

CURVED DISPLAY AND A DRIVING METHOD THEREOF

CROSS-REFERENCE TO RELATED APPLICATION

This application claims priority to and the benefit of Korean Patent Application No. 10-2015-0001364 filed in the Korean Intellectual Property Office on Jan. 6, 2015, the entire contents of which are incorporated herein by reference.

BACKGROUND (a) Technical Field

The present disclosure generally relates to a display device. More particularly, the present disclosure discloses a curved display device and a driving method thereof.

(b) Description of the Related Art

Flat panel displays for displaying information have been developed. Examples of flat panel displays include liquid crystal displays, organic electro-luminescence display devices, plasma display devices, and field emission displays.

In particular, the liquid crystal display (LCD) has several advantages (e.g., light weight, thin form factor, low power consumption, and rendering of full color videos). As a result, the liquid crystal display is widely used in mobile phones, global positioning systems, monitors, televisions, etc.

The liquid crystal display typically includes two substrates on which an electrode is formed and a liquid crystal layer disposed therebetween. An electric field is formed by applying a voltage to the electrodes on the substrates. The electric field changes the alignment of liquid crystal molecules in the liquid crystal layer and controls transmittance of light passing through the liquid crystal layer, so as to generate an image on the liquid crystal display.

In recent years, the sizes of liquid crystal displays have increased. In addition, curved liquid crystal displays have been developed to enhance viewer immersion experience. A curved liquid crystal display can be manufactured to have a constant curvature by applying an external force to a flat liquid crystal display.

However, the image signal that is input to the curved liquid crystal display is usually configured with reference to a flat display device. Since the image signal is not configured for display on the curved liquid crystal display, a viewer may observe a bent and distorted image as a result of the curvature in the curved liquid crystal display.

The above information disclosed in this Background section is to enhance understanding of the background of the inventive concept and therefore it may contain information that does not form the prior art that is already known in this country to a person of ordinary skill in the art.

SUMMARY

The present disclosure addresses at least the above issues, by providing a curved display device that gives a viewer a sense of immersion and that has reduced image distortion.

According to an exemplary embodiment of the inventive concept, a curved display device is provided. The curved display device includes: a curved panel including a plurality of pixels; and an image compensation processor, wherein the image compensation processor is configured to: convert a first image signal into a second image signal by scaling the first image signal based on a curvature of the curved panel and a viewing distance between a viewer and the curved panel, map the second image signal onto corresponding pixels of the curved panel, and provide the mapped second image signal to the corresponding pixels of the curved panel.

In some embodiments, the curved display device may further include a viewer distance measuring apparatus attached to the panel.

In some embodiments, the viewer distance measuring apparatus may include a camera.

In some embodiments, the image compensation processor may further include: a viewer position determiner configured to determine the viewing distance; a scaling ratio calculator configured to scale the first image signal by a first ratio based on the viewing distance determined by the viewer position determiner and the curvature of the curved panel; and a pixel data mapper configured to map the second image signal output by the scaling ratio calculator onto the corresponding pixels of the curved panel, and provide the mapped second image signal to the corresponding pixels of the curved panel.

In some embodiments, the first ratio may increase as the viewing distance decreases.

In some embodiments, the first ratio may increase as a radius of the curvature decreases.

In some embodiments, the scaling ratio calculator may be configured to: enlarge a first image associated with the first image signal, wherein the first image is enlarged by the first ratio at a top, bottom, right, and left of the first image based on the viewing distance and the curvature of the curved panel, and incise a top and bottom-side image data region exceeding a resolution of the enlarged first image, so as to generate the second image signal.

In some embodiments, the scaling ratio calculator may be configured to: enlarge a first image associated with the first image signal by the first ratio based on the viewing distance and the curvature of the curved panel, and apply per-region weight values to a top and bottom-side image data region of the enlarged first image, so as to generate the second image signal.

In some embodiments, a first weight value may be set to a pixel area provided near a center portion of the curved panel, a second weight value may be set to another pixel area provided near an edge of the curved panel, and the second weight value may be less than the first weight value.

In some embodiments, the weight values may be reduced as the viewing distance decreases.

In some embodiments, the weight values may be reduced as a radius of the curvature decreases.

According to another embodiment of the inventive concept, a method for driving a curved display device is provided. The curved display device comprises a curved panel including a plurality of pixels. The method includes: determining a viewing distance between a viewer and the curved panel; scaling a first image signal based on the viewing distance and a curvature of the curved panel, so as to convert the first image signal into a second image signal; and mapping the second image signal onto corresponding pixels of the curved panel, and providing the mapped second image signal to the corresponding pixels of the curved panel.

In some embodiments, converting the first image signal into the second image signal may further include: enlarging a first image associated with the first image signal by a first ratio, wherein the first image is enlarged by the first ratio at a top, bottom, right, and left of the first image based on the viewing distance and the curvature of the curved panel; and incising a top and bottom-side image data region exceeding a resolution of the enlarged first image, so as to generate the second image signal.

In some embodiments, the first ratio may increase as the viewing distance decreases.

In some embodiments, converting the first image signal into the second image signal may further include: enlarging a first image associated with the first image signal by a first ratio based on the viewing distance and the curvature of the curved panel; and applying per-region weight values to a top and bottom-side image data region of the enlarged first image, so as to generate the second image signal.

In some embodiments, a first weight value may be set to a pixel area provided near a center portion of the curved panel, a second weight value may be set to another pixel area provided near an edge of the curved panel, and the second weight value may be less than the first weight value.

In some embodiments, the weight values may be reduced as the viewing distance decreases.

DETAILED DESCRIPTION

Figure 1:
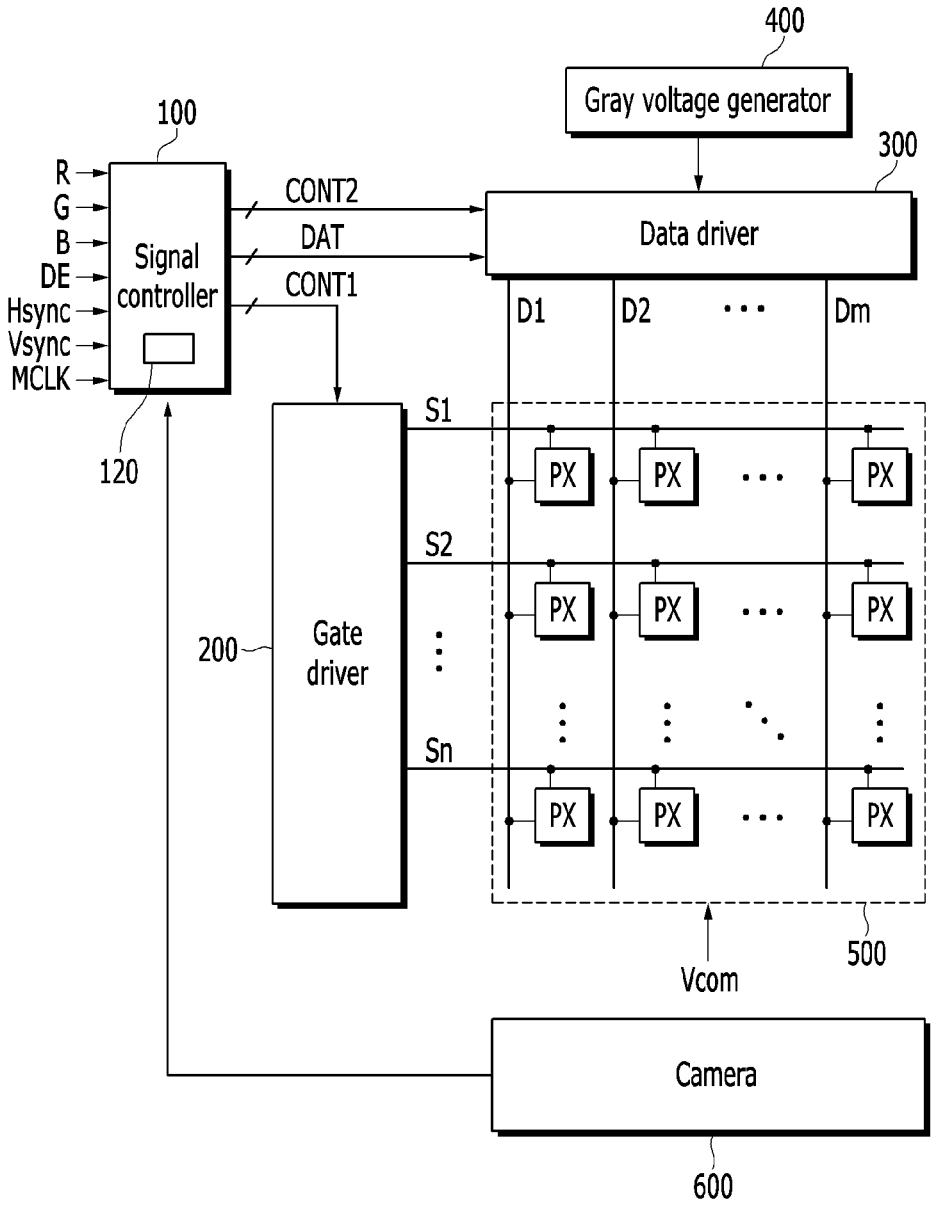
FIG. 1 illustrates a block diagram of a curved liquid crystal display according to an exemplary embodiment.

In the following description, certain exemplary embodiments of the inventive concept have been shown and described, by way of illustration. As those skilled in the art would realize, the embodiments may be modified in various ways without departing from the spirit or scope of the inventive concept.

Certain features known to those skilled in the art may have been omitted from the embodiments to avoid obscuring the inventive concept. Like reference numerals designate like elements throughout the specification. In some instances, a repeat description of those similar elements may be omitted.

When an element is described as being "coupled" to another element, the element may be "directly coupled" to the other element or "electrically coupled" to the other element through a third element. In addition, unless expressed otherwise, the word "comprise" and variations such as "comprises" or "comprising" will be understood to imply the inclusion of stated elements but not the exclusion of any other elements.

In the drawings, the thickness of layers, films, panels, regions, etc., may be exaggerated for clarity. It will be understood that when an element such as a layer, film, region, or substrate is referred to as being "on" another element, it can be directly on the other element or intervening elements may also be present. In contrast, when an element is referred to as being "directly on" another element, there are no intervening elements present.

A curved liquid crystal display according to exemplary embodiments of the inventive concept is next described with reference to accompanying drawings. Although the embodiments are described using a liquid crystal display as an example, the inventive concept is not limited thereto, and is also applicable to other types of curved display devices such as an organic electro-luminescence display device (OLED).

FIG. 1 illustrates a block diagram of a curved liquid crystal display according to an exemplary embodiment.

Referring to FIG. 1, the curved liquid crystal display includes a signal controller 100, a gate driver 200, a data driver 300, a gray voltage generator 400, a liquid crystal panel 500, and a camera 600.

The liquid crystal panel 500 includes an upper substrate, a lower substrate, and a liquid crystal material provided between the upper and lower substrates. The liquid crystal panel 500 includes a plurality of gate lines (S1-Sn), data lines (D1-Dm), and pixels PX. The pixels PX are connected to the gate lines (S1-Sn) and the data lines (D1-Dm) and are substantially arranged in a matrix form. The gate lines (S1-Sn) extend substantially in a row direction and are parallel with each other. The data lines (D1-Dm) extend substantially in a column direction and are parallel with each other. Although FIG. 1 illustrates the gate lines (S1-Sn) and data lines (D1-Dm) being connected to the pixels PX, it is noted that various signal lines such as a power voltage supply line or a voltage-division reference voltage line may also be connected to the pixels PX depending on a configuration of the pixels PX or a driving method of the pixels PX.

In some embodiments, a backlight unit (not shown) for irradiating light to the liquid crystal panel 500 is provided on a rear side of the liquid crystal panel 500.

The signal controller 100 receives image signals R, G, and B and an input control signal. The image signals R, G, and B include luminance information on a plurality of pixels. The input control signal includes a data enable signal DE, a horizontal synchronizing signal Hsync, a vertical synchronization signal Vsync, and a main clock signal MCLK.

The signal controller 100 generates a gate control signal CONT1, a data control signal CONT2, and an image data signal DAT according to the image signals R, G, and B, the data enable signal DE, the horizontal synchronizing signal Hsync, the vertical synchronization signal Vsync, and the main clock signal MCLK.

The signal controller 100 includes an image compensation processor 120 for scaling the input image signals R, G, and B by a predetermined ratio based upon a viewing position of a viewer and a curvature of a curved liquid crystal display, and mapping the scaled image signals R', G', and B' to the respective pixels of the curved display device.

The signal controller 100 divides the scaled image signals R', G', and B' for respective frames according to the vertical synchronization signal Vsync, and divides the converted image signals R', G', and B' for respective gate lines according to the horizontal synchronizing signal Hsync so as to generate the image data signal DAT.

The signal controller 100 provides the image data signal DAT and the data control signal CONT2 to the data driver 300. The data control signal CONT2 is a signal for controlling the data driver 300. The data control signal CONT2 includes a horizontal synchronization start signal STH for notifying a start of transmission of an image data signal DAT, a load signal LOAD for instructing the data lines (D1-Dm) to output a data signal, and a data clock signal HCLK. The data control signal CONT2 may further include a reversing signal RVS for reversing a voltage polarity of the image data signal DAT for a common voltage Vcom.

The signal controller 100 provides the gate control signal CONT1 to the gate driver 200. The gate control signal CONT1 includes a scanning start signal STV at the gate driver 200 and at least one clock signal for controlling an output of a gate-on voltage. The gate control signal CONT1 may further include an output enable signal OE for controlling a continuation time of the gate-on voltage.

The data driver 300 is connected to the data lines (D1-Dm) of the liquid crystal panel 500. The data driver 300 selects a gray voltage from the gray voltage generator 400 and applies the selected gray voltage to the data line (D1-Dm) as a data signal. The gray voltage generator 400 may provide a predetermined number of reference gray voltages rather than voltages for all grays. In an embodiment in which the gray voltage generator 400 provides a predetermined number of reference gray voltages, the data driver 300 may divide the reference gray voltages to generate gray voltages for all grays and select a data signal from among the generated gray voltages.

The gate driver 200 applies a gate signal. The gate signal is a combination of a gate-on voltage for turning on a switching element connected to the gate lines (S1-Sn) of the liquid crystal panel 500 and a gate-off voltage for turning off the switching element connected to the gate lines (S1-Sn).

The camera 600 is provided on an upper portion of the liquid crystal display to capture an image of a viewer. The camera 600 provides the captured image of the viewer to the signal controller 100.

Figure 2:
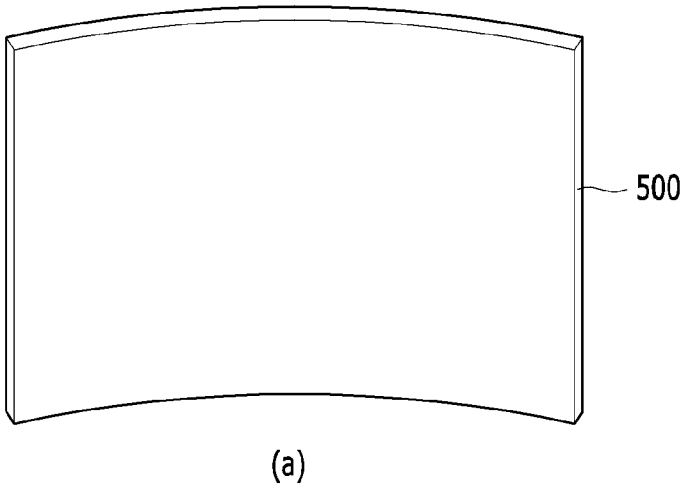
FIG. 2 illustrates a curved liquid crystal panel in a curved liquid crystal display according to an exemplary embodiment.
Figure 2:
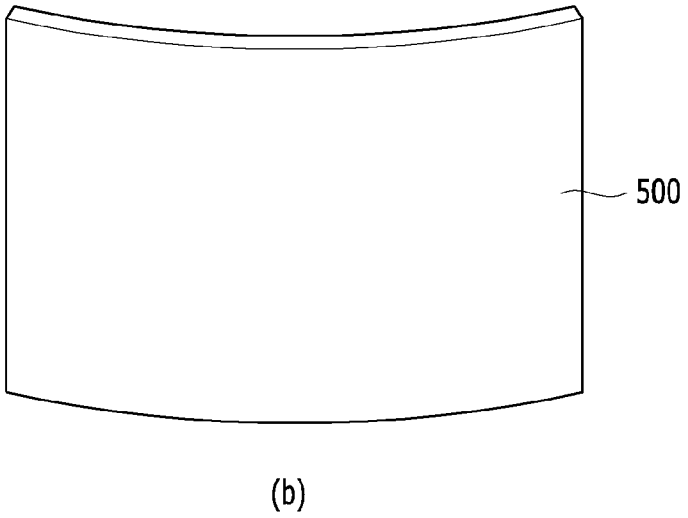

Referring to FIG. 2, the liquid crystal panel 500 of the curved liquid crystal display may be formed as a concave type as shown in FIG. 2(*a*), or a convex type as shown in FIG. 2(*b*). For the concave type, a center portion of the liquid crystal panel 500 is curved backward from the respective edges with respect to an observer. For the convex type, a center portion of the liquid crystal panel 500 is curved forward from the respective edges with respect to an observer.

The concave or convex liquid crystal panel 500 may be formed having a constant curvature. In some embodiments, the curvature at the center portion of the liquid crystal panel 500 may be different from the curvature of the respective edges of the liquid crystal panel 500 (i.e., the liquid crystal panel 500 may have multiple curvatures at different locations). For the embodiments described herein, the liquid crystal panel 500 may be assumed to be concave.

Figure 3:
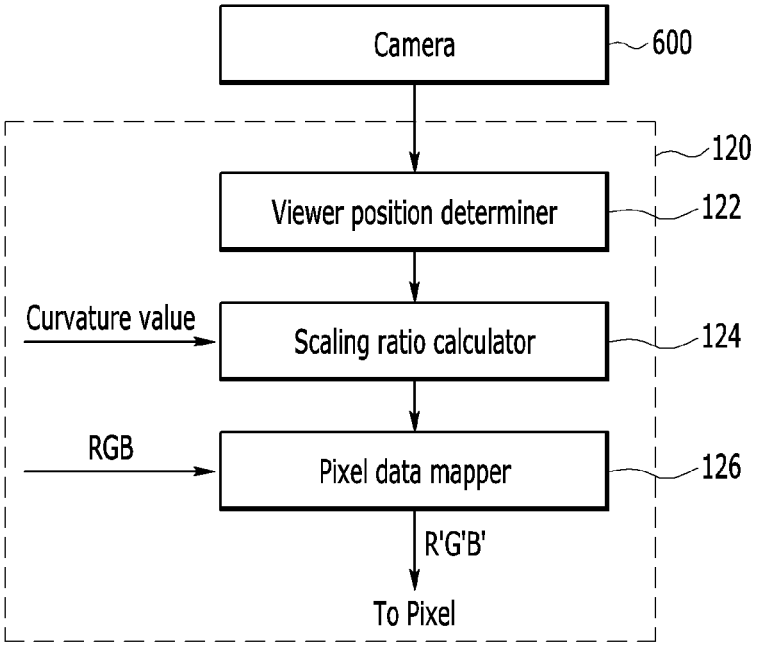
FIG. 3 illustrates an image compensation processor according to an exemplary embodiment.

FIG. 3 illustrates a block diagram of an image compensation processor 120 according to an exemplary embodiment.

The image compensation processor 120 includes a viewer position determiner 122, a scaling ratio calculator 124, and a pixel data mapper 126.

The viewer position determiner 122 determines a viewing distance of the viewer from the liquid crystal display based on the captured image of the viewer provided by the camera 600.

The scaling ratio calculator 124 scales the image according to a predetermined ratio such that the scaled image fits an actual screen size observed by the viewer. The predetermined ratio is based on the viewing distance determined by the viewer position determiner 122 and the stored curvature value of the liquid crystal display.

The pixel data mapper 126 maps the scaling image signals R', G', and B' onto the corresponding pixels of the curved display device. The scaling image signals R', G', and B' are calculated by the scaling ratio calculator 124.

Next, a method for compensating and processing an image of a curved display device according to a first exemplary embodiment will be described with reference to FIGS. 4, 5, 6, 7A, and 7B.

Figure 4:
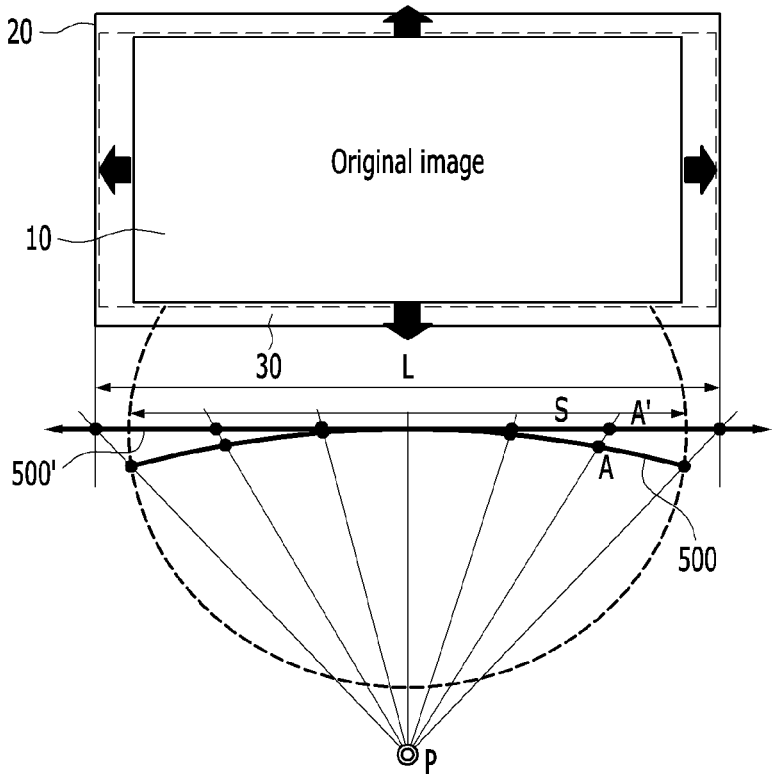
FIGS. 4, 5, 6, 7A, and 7B illustrate a method for compensating and processing an image according to an exemplary embodiment.

As shown in FIG. 4, when a viewer located at a viewing point (P) focuses on a specific point (A) on the curved display device 500, the viewer experiences the effect of viewing a point A' on the flat display device 500' such that the image seems enlarged. When a length of the curved display device is S, the viewer would feel as though he/she is viewing the image on the flat display device having a length L (whereby L is greater than S). According to the first exemplary embodiment, an image 10 of the original image is enlarged into an image 20 by a predetermined scaling ratio, as described below.

Figure 5:
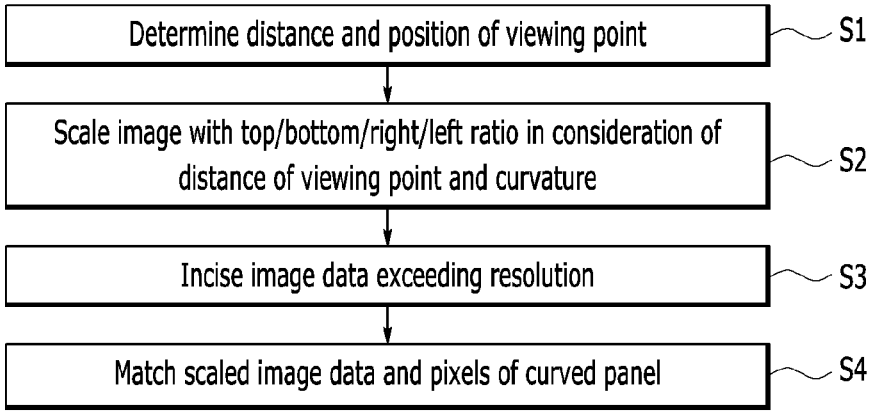

Referring to FIG. 5, a distance and a position of the viewing point are determined based upon image information of the viewer input through the camera 600 (Step S1). The checking of the viewer's position and determining of the viewing distance through the camera is known to one of ordinary skill in the art, and need not be described. In the embodiments, the viewing distance of the viewer is determined through the camera. However, the inventive concept is not limited thereto. In some other embodiments, a sensor may be used to measure the viewing distance of the viewer.

Based on the viewing distance of the viewer determined in Step S1 and the known curvature of the curved display device, the original image is then enlarged by a predetermined ratio (herein referred to as a scaling ratio) at its top, bottom, right, and left to fit an actual observed screen size. That is, the original image 10 is enlarged according to a predetermined scaling ratio and converted into an enlarged image 20 (Step S2).

Next, a top and/or bottom image data region 30 exceeding a resolution of the enlarged image 20 is incised to generate scaled image data R', G', and B' (Step S3).

The scaled image data R', G', and B' are mapped onto the corresponding pixels of the curved display device. Specifically, the converted image data mapping onto the corresponding pixels of the curved display device are output with reference to the image of the virtual enlarged flat display device at the viewing position (Step S4).

Figure 6:
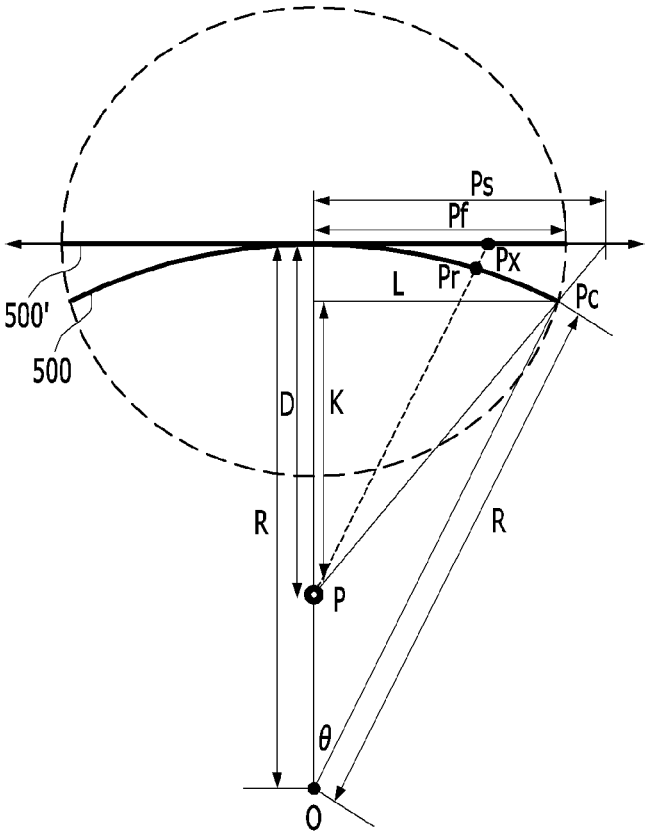

FIG. 6 illustrates a method for matching the scaled image data R', G', and B' and the curved display device according to the first exemplary embodiment.

In FIG. 6, a length of a virtual flat panel Ps is determined by Equation 1, whereby an image length of an actual flat panel is Pf, an image length of a curved panel is Pc, a curvature radius of the curved panel is R, and a viewing distance is D.

$$Pf = Pc = R\theta \qquad \text{(Equation 1)}$$

$$\theta = Pf / R = Pc / R$$

$$L = R\sin\theta$$

$$K = R\cos\theta - (R - D) = D - R(1 - \cos\theta)$$

$$K : L = D : Ps$$

$$Ps = \frac{L \times D}{K} = \frac{RD\sin\theta}{D - R(1 - \cos\theta)}, \theta = Pc / R$$

$$Ps = \frac{RD\sin\left(\frac{Pc}{R}\right)}{D - R\left(1 - \left(\cos\left(\frac{Pc}{R}\right)\right)\right)}$$

Based on Equation 1, the relationship between a pixel position Pr of the curved panel and a pixel position Px of the scaled image is obtained in Equation 2.

$$Px = \frac{RD\sin\left(\frac{Pr}{R}\right)}{D - R\left(1 - \cos\left(\frac{Pr}{R}\right)\right)} \quad \text{(Equation 2)}$$

In the first exemplary embodiment, the converted image data (data of the pixel position Pr) mapping onto the corresponding pixels of the curved panel may be output with reference to the image data (data of the pixel position Px) of the virtual enlarged flat panel at the viewing position, using Equation 2. As shown in Equation 2, a difference of a pixel position between a virtual flat panel and the original image increases as the radius (R) of the curvature and the viewing distance decrease.

Figure 7A:
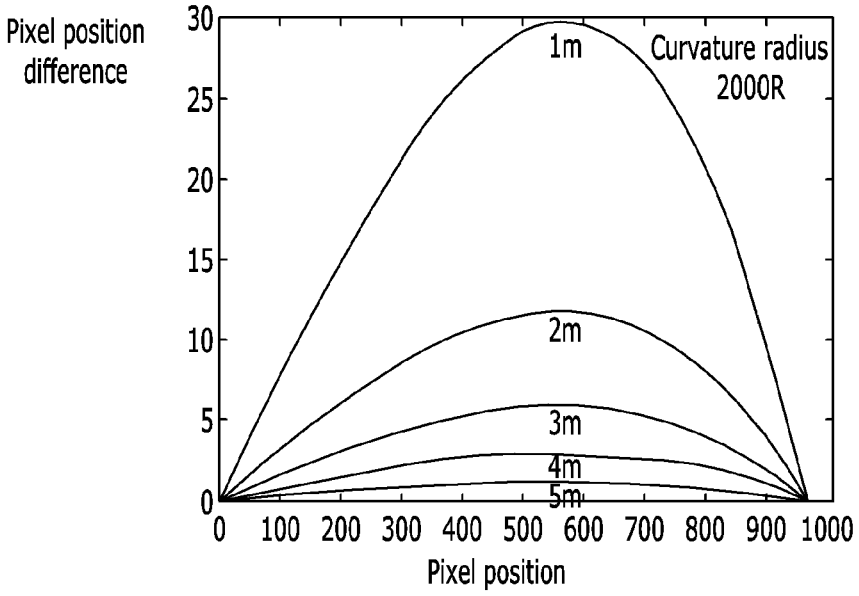

Referring to FIG. 7A, when the width is 1220 mm (about 55 diagonal inches) and the curvature radius is 2000 R (the measurement unit of R is mm), the position difference of the pixel positions at the viewing distances of 1 m, 2 m, 3 m, 4 m, and 5 m is shown. A horizontal axis represents a pixel position in a center of the panel, and a vertical axis represents a pixel position difference (i.e., a distortion compensated amount) of the corresponding virtual flat panel. For example, an image corresponding to the pixel position of 520 of the original image is mapped onto the pixel position of 550 of the curved panel. It is found that the compensated amount (i.e., pixel position difference) of image distortion increases as the viewing distance decreases.

Figure 7B:
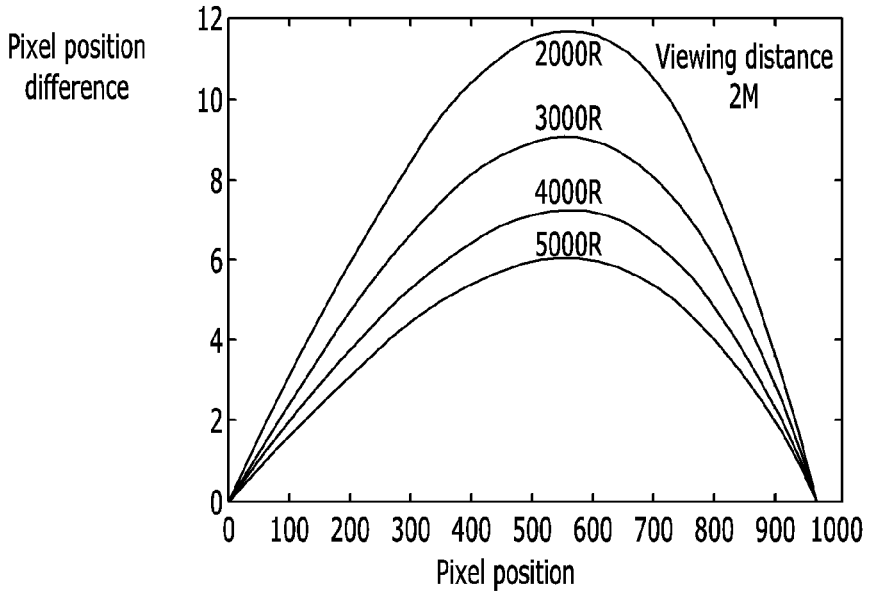

Referring to FIG. 7B, when the width is 1220 mm and the viewing distance is 2 m, the position difference of the pixel positions with the curvature radii of 2000 R (the measurement unit of R is mm), 3000 R, 4000 R, and 5000 R is shown. It is found that the curvature increases and the compensated amount (i.e., pixel position difference) of image distortion increases as the curvature radius decreases.

In the first exemplary embodiment, the image is processed to remove the image distortion according to the viewer position detected by the camera and the curvature of the curved display device. Accordingly, the exemplary curved display device can provide a sense of immersion and has reduced image distortion.

Next, a method for compensating and processing an image of a curved display device according to a second exemplary embodiment will be described with reference to FIGS. 8A, 8B, 8C, 9A, 9B, 10, 11, 12A, and 12B.

Figure 8A:
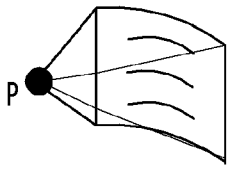
FIGS. 8A, 8B, 8C, 9A, 9B, 10, 11, 12A, and 12B illustrate a method for compensating and processing an image according to another exemplary embodiment.
Figure 8B:
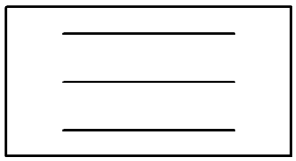
Figure 8C:
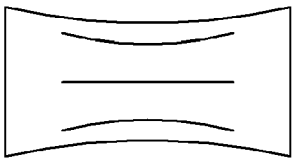

Referring to FIG. 8A, all portions of the curved display device have a same distance at the viewing point (P). Thus, the curved display device could be physically represented as FIG. 8B. However, referring to FIG. 8C, a center portion other than respective end portions of the display device becomes concave in order to observe a shape on the virtual flat display device.

Figure 9A:
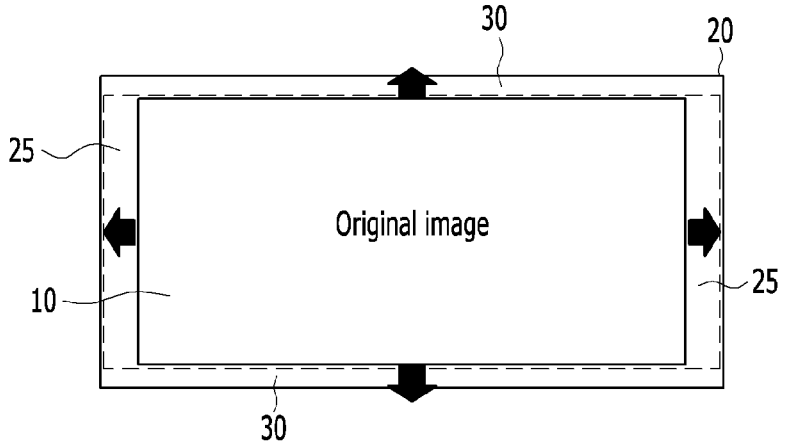
Figure 9B:
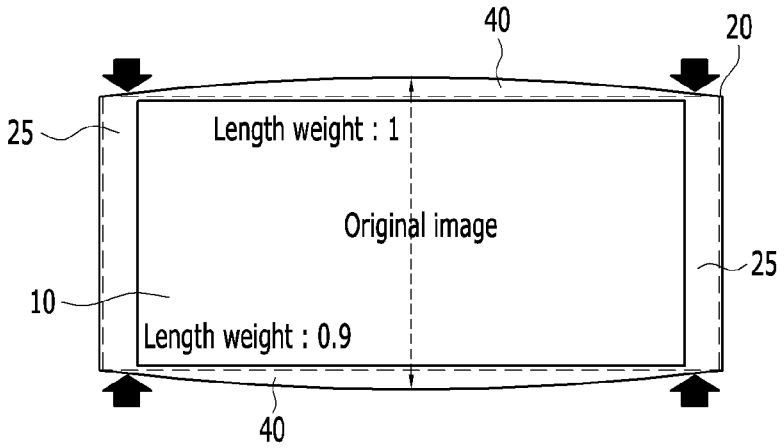
Figure 10:
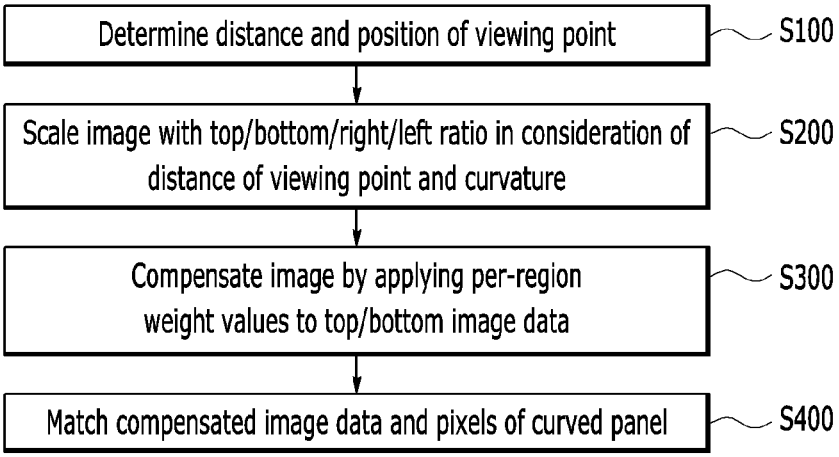

Referring to FIG. 9A and FIG. 9B, the method for compensating and processing an image according to the second exemplary embodiment includes setting different weight values (e.g., a weight value 1 is applied to the center region and a weight value 0.9 is applied to the edge in FIG. 9A and FIG. 9B) for the respective regions to the top and/or bottom-side image 30 from among the image scaled (or enlarged) with a predetermined ratio, so as to prevent the center portion from becoming concave. As shown in FIG. 10, according to the second exemplary embodiment, the distance and the position of the viewing point is determined based on image information of the viewer input through the camera 600 (Step S100).

Based on the viewing distance of the viewer determined in Step S100 and the known curvature of the curved display device, the original image is then enlarged by a predetermined ratio (the scaling ratio) at its top, bottom, right, and left to fit an actual observed screen size (Step S200).

Next, per-region weight values are provided to the top and/or bottom side image data from among the enlarged image data 20 to compensate the image. Specifically, the weight values of the image data at the respective ends are set to be less than the weight values of the image data in the center portion of the image data. That is, the image is corrected with a small weight value as the position becomes more distant from the center portion of the display device (Step S300).

The image data R', G', and B' to which the weight values are set and which are compensated are then mapped onto the corresponding pixels of the curved display device. In detail, according to the second exemplary embodiment, the converted image data mapping on the corresponding pixels of the curved display device are output with reference to the image of the virtual enlarged flat display device at the viewing position (Step S400).

Figure 11:
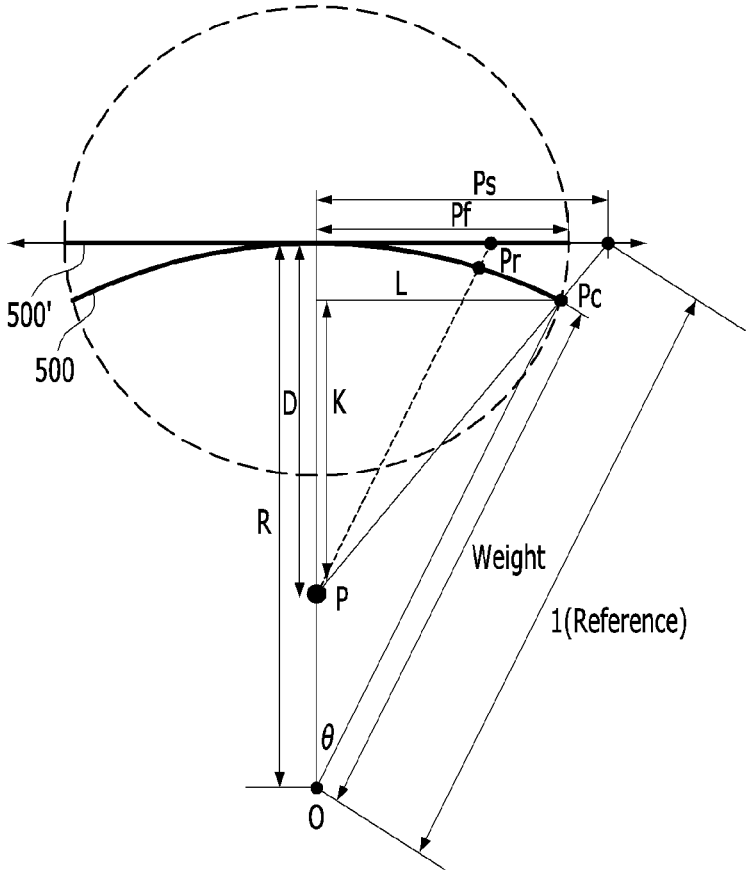

FIG. 11 illustrates a method for setting weight values for respective regions according to the second exemplary embodiment.

Referring to FIG. 11, the weight value at the pixel position Px of the scaled image is determined by Equation 3, whereby an image length of an actual flat panel is Pf, a length of a virtual flat panel is Ps, an image length of a curved panel is Pc, a curvature radius of the curved panel is R, and a viewing distance is D.

$$Pf = Pc = R\theta \quad \text{(Equation 3)}$$

$$\theta = Pf / R = Pc / R$$

$$K = R\cos\theta - (R - D) = D - R(1 - \cos\theta)$$

$$D : K = 1 : \text{Weight}$$

$$\text{Weight} = \frac{K}{D} = \frac{D - R(1 - \cos\theta)}{D}, \ \theta = Pc / R$$

$$\text{Weight} = \frac{D - R\left(1 - \cos\left(\frac{Pc}{R}\right)\right)}{D}$$

Based on Equation 3, a weight value Wr at the pixel position Pr of the curved panel is obtained from Equation 4.

$$Wr = \frac{D - R\left(1 - \cos\left(\frac{Pr}{R}\right)\right)}{D} \quad \text{(Equation 4)}$$

As shown in Equation 4, the weight value is reduced as the curvature radius and the viewing distance decrease.

Figure 12A:
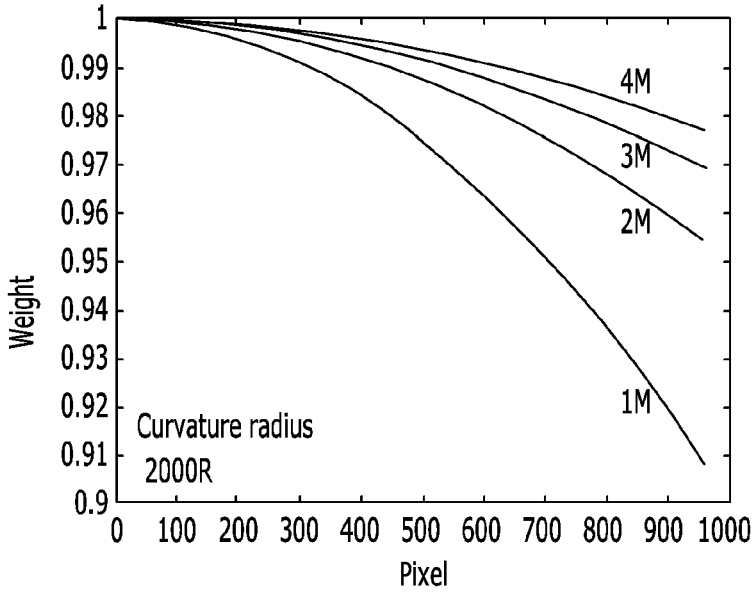

Referring to FIG. 12A, when the width is 1220 mm (about 55 diagonal inches) and the curvature radius is 2000 R (the measurement unit of R is mm), the weight value calculated at the viewing distances of 1 m, 2 m, 3 m, 4 m, and 5 m is shown. The horizontal axis represents a pixel position in the center of the panel, and the vertical axis represents a weight value for correcting data.

As shown in FIG. 12A, the weight value decreases as the position becomes more distant from the center of the panel, and the weight value is reduced as the viewing distance decreases.

Figure 12B:
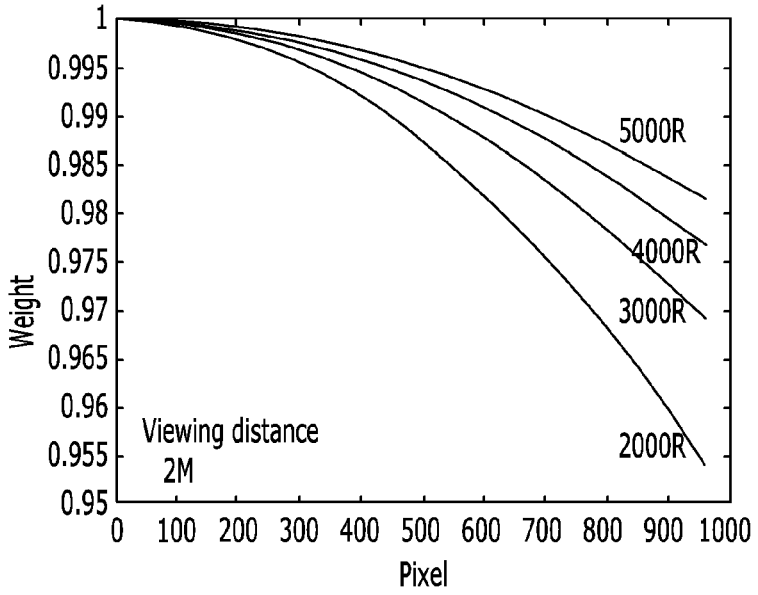

Referring to FIG. 12B, when the width is 1220 mm and the viewing distance is 2 m, the weight value calculated at the curvature radii of 2000 R (the measurement unit of R is mm), 3000 R, 4000 R, and 5,000 R is shown. As shown in FIG. 12B, the weight value is reduced as the curvature radius decreases.

According to the second exemplary embodiment, smaller weight values are set to the top and/or bottom-side image 30 from among the image scaled (or enlarged) by a predetermined ratio as the position becomes more distant from the center portion, thus preventing the center portion from becoming concave.

Furthermore, the image is processed to remove the image distortion according to the viewer position detected by the camera and the curvature of the curved display device. Accordingly, the curved display device can provide a sense of immersion and has reduced image distortion.

The accompanying drawings and the exemplary embodiments are used to describe the inventive concept but should not be construed in a limiting manner. It will be understood by those of ordinary skill in the art that various modifications and equivalent embodiments may be made to the embodiments without departing from the scope of the present disclosure.

What is claimed is:

1. A curved display device comprising:

a curved panel including a plurality of pixels; and an image compensation processor, wherein the image compensation processor is configured to:

convert a first image signal into a second image signal by scaling the first image signal based on a curvature of the curved panel and a viewing distance between a viewer and the curved panel, map the second image signal onto corresponding pixels of the curved panel, provide the mapped second image signal to the corresponding pixels of the curved panel, and scale the first image signal by a first ratio based on the viewing distance, wherein the first ratio increases as the viewing distance decreases.

2. The curved display device of claim 1, wherein the curved display device further comprises a viewer distance measuring apparatus attached to the curved panel.

3. The curved display device of claim 2, wherein the viewer distance measuring apparatus includes a camera.

4. The curved display device of claim 1, wherein the image compensation processor further comprises:

a viewer position determiner configured to determine the viewing distance;

a scaling ratio calculator configured to scale the first image signal by the first ratio based on the viewing distance determined by the viewer position determiner and the curvature of the curved panel; and a pixel data mapper configured to map the second image signal output by the scaling ratio calculator onto the corresponding pixels of the curved panel, and provide the mapped second image signal to the corresponding pixels of the curved panel.

5. The curved display device of claim 4, wherein the scaling ratio calculator is configured to:

enlarge a first image associated with the first image signal, wherein the first image is enlarged by the first ratio at a top, bottom, right, and left of the first image based on the viewing distance and the curvature of the curved panel, and incise a top and bottom-side image data region exceeding a resolution of the enlarged first image, so as to generate the second image signal.

6. The curved display device of claim 4, wherein the scaling ratio calculator is configured to:

enlarge a first image associated with the first image signal by the first ratio based on the viewing distance and the curvature of the curved panel, and apply per-region weight values to a top and bottom-side image data region of the enlarged first image, so as to generate the second image signal.

7. The curved display device of claim 6, wherein a first weight value is set to a pixel area provided near a center portion of the curved panel, a second weight value is set to another pixel area provided near an edge of the curved panel, and the second weight value is less than the first weight value.

8. The curved display device of claim 6, wherein the weight values are reduced as the viewing distance decreases.

9. The curved display device of claim 6, wherein the weight values are reduced as a radius of the curvature decreases.

10. A curved display device comprising:

a curved panel including a plurality of pixels; and an image compensation processor, wherein the image compensation processor is configured to:

convert a first image signal into a second image signal by scaling the first image signal based on a curvature of the curved panel and a viewing distance between a viewer and the curved panel, map the second image signal onto corresponding pixels of the curved panel, provide the mapped second image signal to the corresponding pixels of the curved panel, and scale the first image signal by a first ratio based on the viewing distance, wherein the first ratio increases as a radius of the curvature decreases.

11. A method for driving a curved display device, the curved display device comprising a curved panel including a plurality of pixels, the method comprising:

determining a viewing distance between a viewer and the curved panel;

scaling a first image signal based on the viewing distance and a curvature of the curved panel, so as to convert the first image signal into a second image signal by enlarging a first image associated with the first image signal by a first ratio; and mapping the second image signal onto corresponding pixels of the curved panel, and providing the mapped second image signal to the corresponding pixels of the curved panel, wherein the first ratio increases as the viewing distance decreases.

12. The method of claim 11, wherein converting the first image signal into the second image signal further comprises:

enlarging the first image associated with the first image signal by the first ratio, wherein the first image is enlarged by the first ratio at a top, bottom, right, and left of the first image based on the viewing distance and the curvature of the curved panel; and incising a top and bottom-side image data region exceeding a resolution of the enlarged first image, so as to generate the second image signal.

13. The method of claim 11, wherein converting the first image signal into the second image signal further comprises:

enlarging a first image associated with the first image signal by a first ratio based on the viewing distance and the curvature of the curved panel; and applying per-region weight values to a top and bottom-side image data region of the enlarged first image, so as to generate the second image signal.

14. The method of claim 11, wherein a first weight value is set to a pixel area provided near a center portion of the curved panel, a second weight value is set to another pixel area provided near an edge of the curved panel, and the second weight value is less than the first weight value.

15. The method of claim 11, wherein the weight values are reduced as the viewing distance decreases.

* * * * *